US006227253B1

(12) United States Patent
Meyns

(10) Patent No.: US 6,227,253 B1
(45) Date of Patent: May 8, 2001

(54) METHOD AND DEVICE FOR TWISTING AT LEAST TWO RUNNING FOR A LOOM SELVAGE FORMING DEVICE

(75) Inventor: Ignace Meyns, Reninge (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/269,191

(22) PCT Filed: Sep. 24, 1997

(86) PCT No.: PCT/EP97/05232

§ 371 Date: Jun. 2, 1999

§ 102(e) Date: Jun. 2, 1999

(87) PCT Pub. No.: WO98/14651

PCT Pub. Date: Apr. 9, 1998

(51) Int. Cl.[7] ..... D03C 7/08; B65H 54/10; B65H 57/28

(52) U.S. Cl. ..... 139/54; 57/334; 57/341; 57/908

(58) Field of Search ..... 242/481.9; 139/54; 57/334, 337, 34.1, 908

(56) References Cited

U.S. PATENT DOCUMENTS

| | | | | |
|---|---|---|---|---|
| 1,216,147 | * | 2/1917 | Lipps | 57/334 |
| 4,204,394 | * | 5/1980 | Luthi | 57/334 |
| 5,456,417 | * | 10/1995 | Kusters | 242/43.2 |
| 5,518,039 | * | 5/1996 | Haeussler et al. | 139/54 |

* cited by examiner

*Primary Examiner*—Andy Falik
(74) *Attorney, Agent, or Firm*—Bacon & Thomas PLLC

(57) ABSTRACT

A rotatable element (10) is configured with a helical, endless thread guide passage (14) which is used to twist at least two threads (8, 9), particularly in a weaving machine's selvage forming device (7). The threads (8, 9) are guided in the passage (14) and displaced axially and mutually crossed by rotating the rotatable element.

17 Claims, 6 Drawing Sheets

8
9
10
15
P
58
F7

FIG. 17
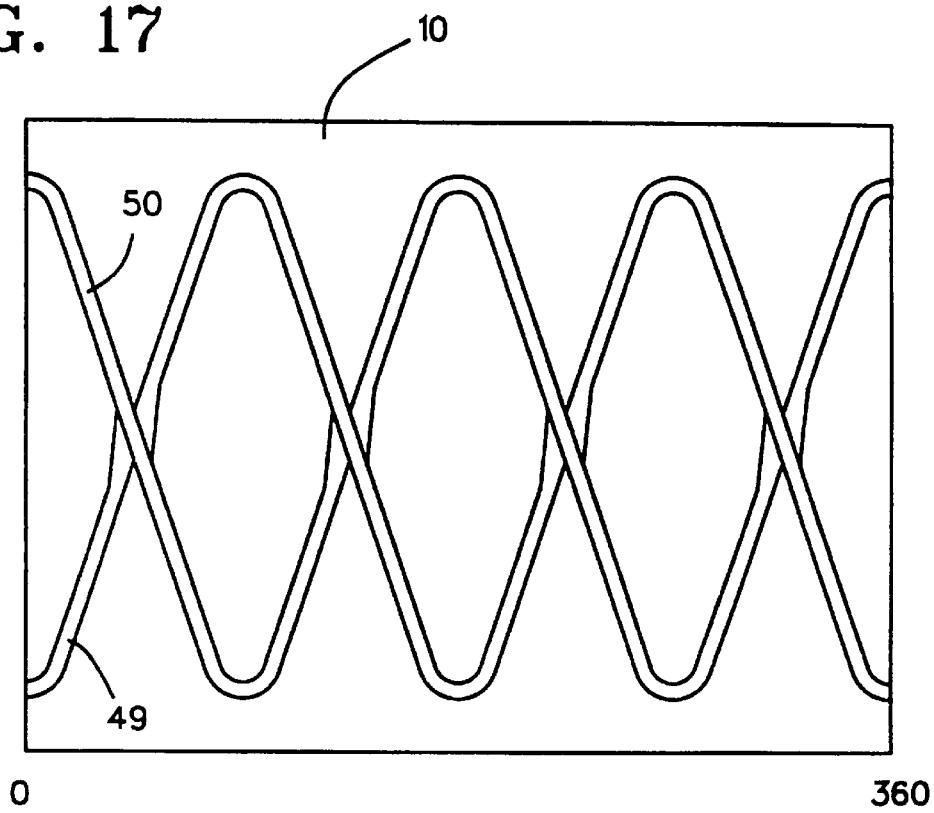
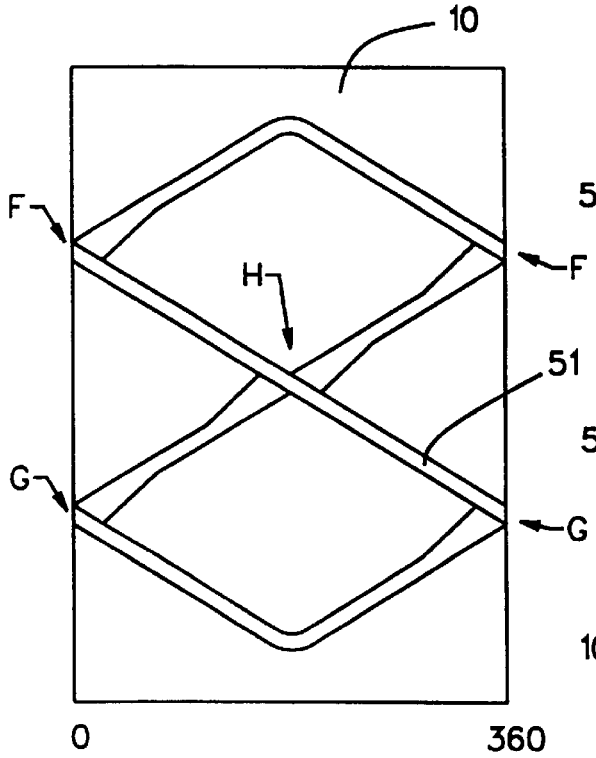
FIG. 18
FIG. 19
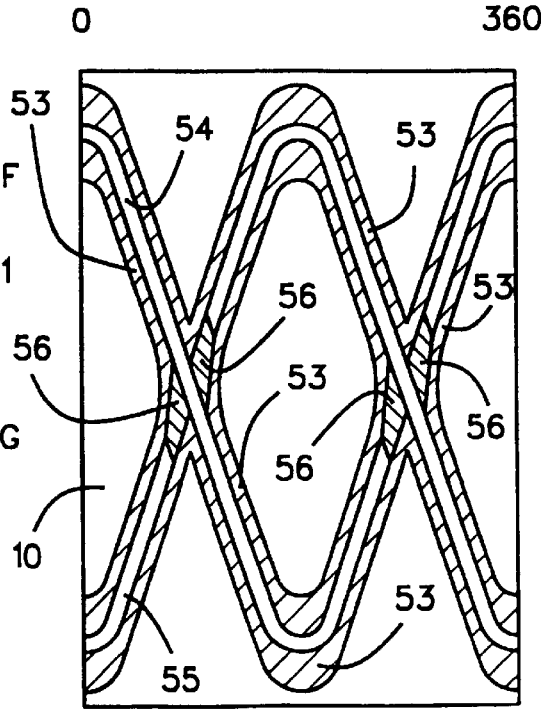

METHOD AND DEVICE FOR TWISTING AT LEAST TWO RUNNING FOR A LOOM SELVAGE FORMING DEVICE

BACKGROUND OF THE INVENTION

1. Field of the Invention

The invention relates to a method and apparatus to twist at least two running threads about each other.

Methods and apparatus to twist at least two moving threads about each other are used on twisting devices to twist threads. Furthermore methods and apparatus to twist at least two moving threads are used in weaving machines to form a selvage weave, with at least two selvage threads being twisted around each other and filling threads being inserted between them. In this manner a selvage or a waste edge will be made.

2. Description of the Related Art

In a known weaving machine selvage forming device (U.S. Pat. No. 4,478,256), reciprocating thread guides are used. A first kind of thread guide consisting of a needle with a thread eye is employed to guide a first selvage thread. Moreover, a second thread guide is employed, consisting of two elements fitted with diagonally opposite slits to guide a second selvage thread. The two thread guides are moved oppositely to each other in order to build a shed from the selvage threads. Also, the two elements of the second thread guide are simultaneously moved in mutually opposite directions with a slight gap between the elements to implement a lateral motion of the selvage thread that is guided through the slits. Such selvage forming devices employ reciprocating thread guides that cause excess noise and vibrations that arise from the additional wear in the drive device of the thread guides.

Another design for a selvage forming device (U.S. Pat. No. 3,880,199) provides a rotating disk with a pair of thread-guiding eyes that are situated diametrically opposite one another, with the axis of rotation positioned between the eyes and each eye guiding one selvage thread.

Another apparatus (French patent document A 2,095,367) uses a pair of eyes oppositely connected to an endless, driven belt, with each eye guiding one selvage thread, to form selvages or waste strips, with the belt driving the eyes substantially synchronously with the weaving machine's shed-forming device.

It is also known (as in British patent 819,583) to false-twist two or more threads and to wind them on a spool. As each of the threads is guided through an axial hole of a toothed wheel, the threads are twisted when the toothed wheel is driven in alternating directions of rotation.

SUMMARY OF THE INVENTION

The object of the invention is a method and apparatus to twist at least two running threads about one another without resorting to thread guide eyes or the like.

This problem is solved by making the threads move substantially transversely and at least approximately tangentially to a rotatable element and are guided in at least one guide passage of the rotating element. This guide passage forces the threads to reciprocate between two end positions in the axial direction of the rotating element and to mutually cross between these end positions.

Such apparatus is easily manufactured and requires only a single drive device. Furthermore, the threads moving along the guide passage migrate over a short distance of their lengths therein, and the wear on the apparatus, which is practically unavoidable, takes place not only at a single site, but instead, the wear is uniformly spread over the length of the guide passage(s). Accordingly, longer service life can be expected in comparison to an apparatus that guides each of the threads through a guide eye as disclosed in the prior art.

In a further development of the invention, at least one thread guide passage, during the thread crossing operation, guides threads at a radial distance from one other. This feature assures that the at least two threads when crossing will not hamper one other, and furthermore the threads will always cross in a predetermined direction.

The present invention solves the stated problem by providing a rotatable element having at least one endless guide passage that runs helically in an axial direction, with at least one crossing site and guiding at least two threads that are directed substantially transverse and approximately tangential to the rotatable element.

A similar rotatable element is known as a thread guiding drum according to the German patent document Al 4,237,860. The thread guiding drum is rotationally driven and which in turn, frictionally drives a bobbin. The thread guiding drum is configured with a thread guide channel to lay crosswise the individual thread moving onto the bobbin.

In an embodiment of the invention, the crossing segments of the guide channels are of differing radial depths, at least at the thread crossing. As a result, the threads will be crossed in a defined manner at the crossing site without hampering or running against each other.

In another embodiment of the invention, the guide passage comprises segments in the zone of the axial end positions and runs in the peripheral direction of the element such that the axial end positions can be reliably be kept constant over a period of time. This feature is especially advantageous when the apparatus is used to form selvages in a weaving machine because the shed formed by the selvage threads can be kept open longer to reliably permit the insertion of one or more fillings.

In a further embodiment of the invention, the rotatable element is mounted on the shaft of an electric drive motor. This design is especially preferred as a weaving machine's selvage forming device because of compactness and ease of assembly on the weaving machine. Moreover, the rotatable element can easily be rotated at constant speed.

In one embodiment, the rotatable element comprises a guide passage with a zone running 360° over the periphery of the cylinder surface from one axial end position to the other. In addition, a zone running at the oppositely directed slope also runs over 360° of the periphery of the cylinder surface between the two axial end positions, whereby the two zones form a crossing site approximately at the middle of the cylinder surface. In this embodiment the diameter of the cylindrical element may be comparatively small and as a result the apparatus may be kept compact and will be especially suitable as a weaving machine's selvage forming device.

In a further embodiment, the rotatable element comprises at least two endless guide passages running over a peripheral angle of 360° of the rotatable element, at least twice between the axial end positions and crossing each other at least twice per revolution of the rotating element. In this embodiment the threads can be looped twice about each other per each revolution of the rotatable element.

In yet another embodiment, at least two guide passages run between an end position in the zone of an axial end of the rotatable element and an end position in the zone of the axial middle position of this element, the crossing locations being provided in the zone of the middle end positions.

BRIEF DESCRIPTION OF THE DRAWINGS

An arrangement according to this invention is shown in the attached drawings:

FIGS. 16, 17, and 18 are views of geometric developments at the surfaces of rotatable elements having guide passages of different shapes; and FIG. 19 is a partial sectional view of a geometric development at a surface of another embodiment of the rotatable element.

DETAILED DESCRIPTION OF THE PREFERRED EMBODIMENT

Figure 1:
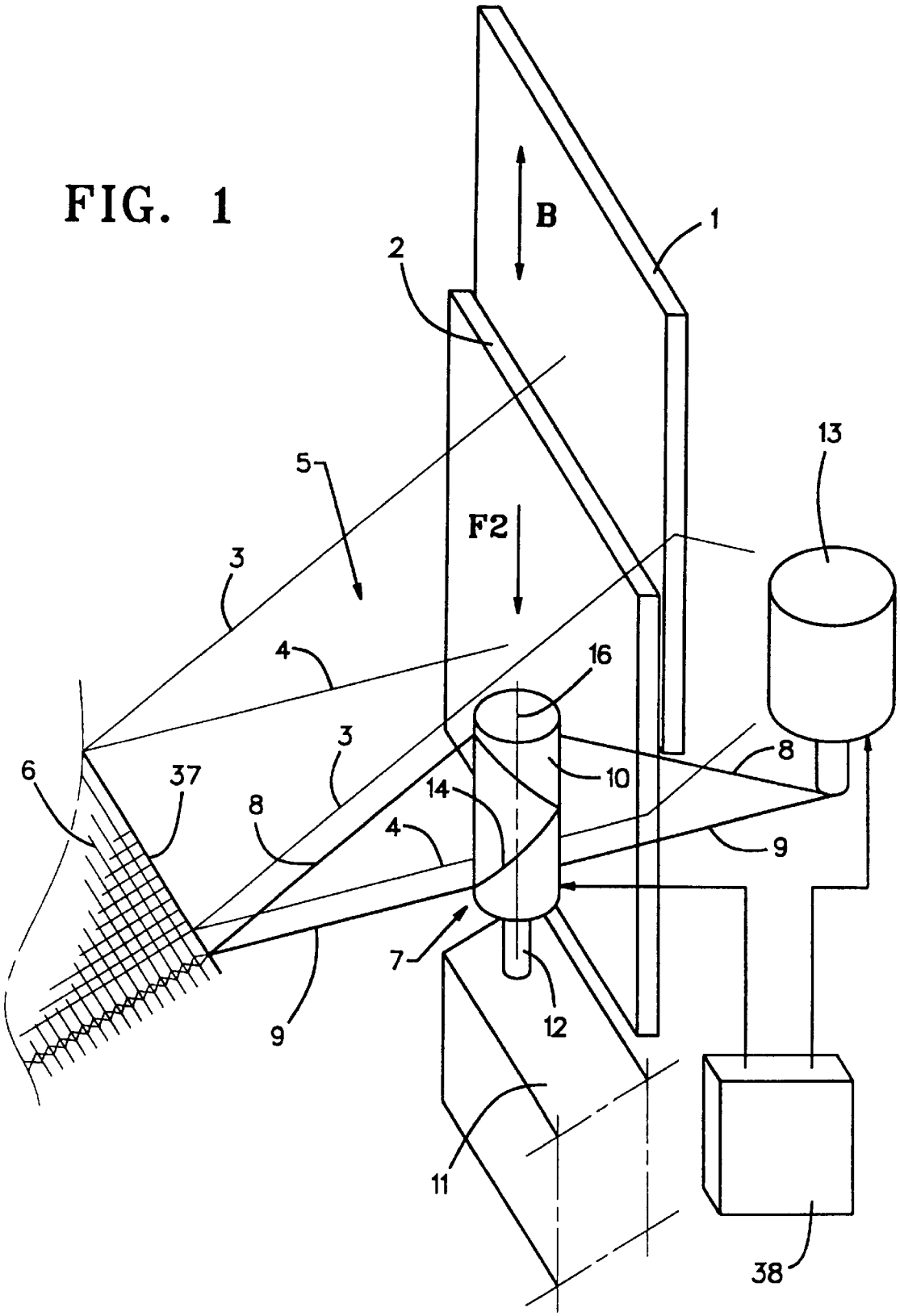
FIG. 1 is a perspective cutaway view of a weaving machine equipped with the apparatus of the present invention.

The weaving machine shown in cutaway manner in FIG. 1 is configured with a shed-forming device, including harnesses 1, 2 forming a shed 5 from warp threads 3, 4. A filling 37 is inserted into the particular shed 5 formed and is beat against the edge of a fabric of warp threads and fillings. The prepared fabric 6 is pulled away by a removal device, not shown.

In addition the weaving machine is configured with a selvage forming device 7 shown in schematic manner in FIG. 1. The selvage forming device 7 operates with two selvage threads 8, 9 to substantially form sheds coincident with the particular formed shed 5 and receiving the inserted filling 37, the result of which, a selvage or a waste strip is formed from the selvage threads 8, 9 and the fillings.

The selvage forming device 7 contains a rotatable element in the form of a cylinder 10. This cylinder 10 is rotated by a shaft 12 which is mounted on a frame 11. Illustratively, this frame 11 is adjustably affixed in the direction of the fillings by elements that are not illustrated. Additionally, a supply unit 13 is provided for the selvage threads 8, 9 to untwist the selvage threads between the cylinder 10 and the supply unit 13. This untwisting occurs when the supply unit 13 rotates in a direction counter to that of the cylinder 10 that directs the selvage threads 8, 9. Devices similar to such a supply unit 13 and its drive are discussed in U.S. Pat. Nos. 3,880,199 and 3,998,247 and also in CS patent 172,136.

Figures 2, 5, 6:
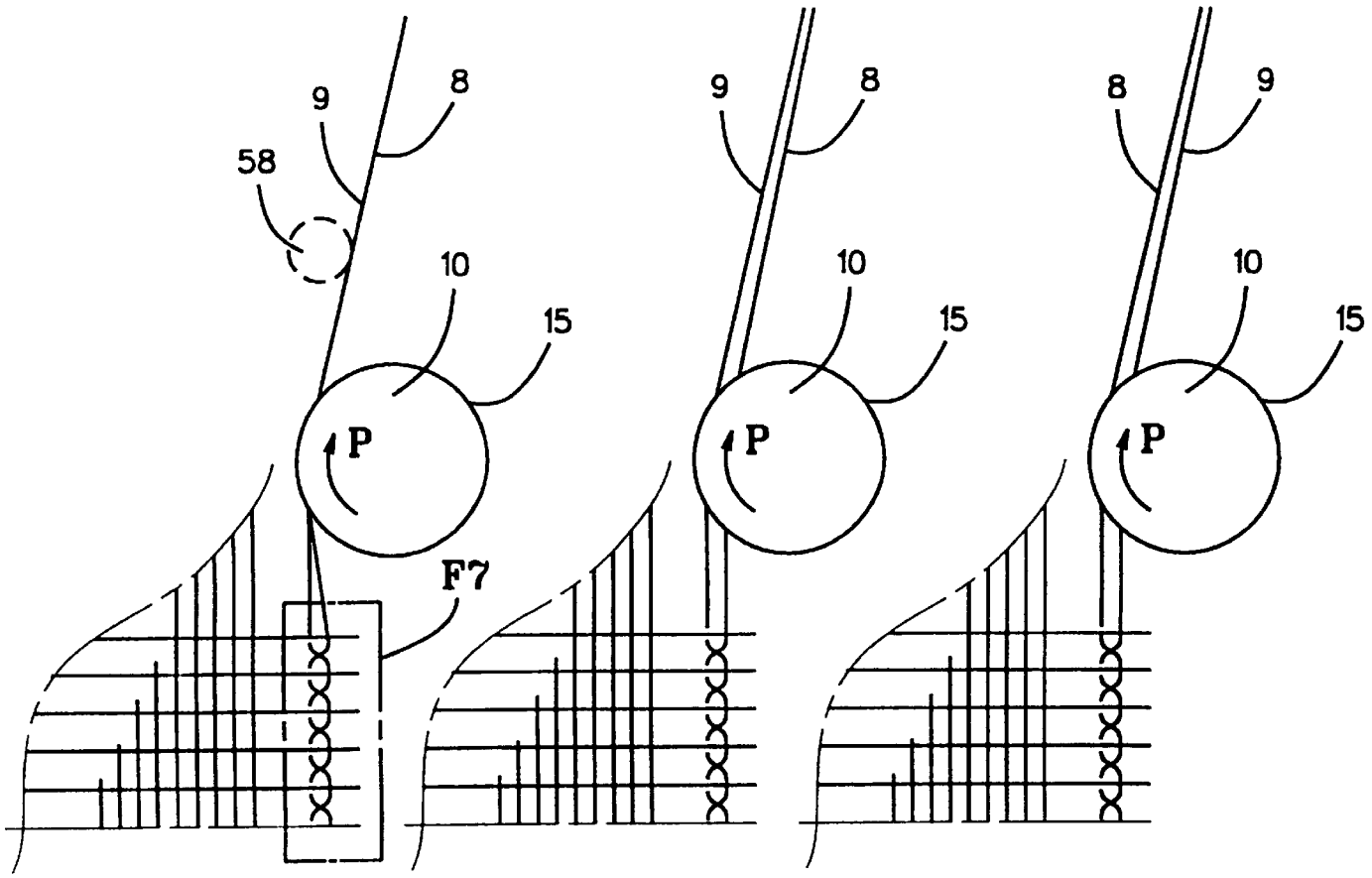
FIG. 2 is a view in the direction of arrow F2 of FIG. 1 of the schematically shown apparatus of the present invention.
FIG. 5 is a view similar to FIG. 2 at another thread position.
FIG. 6 is a view similar to FIG. 2 with yet a different thread position.

A guide passage in the form of a guide channel 14 is present in the surface 15 of the cylinder 10 to guide the two selvage threads 8,9 in such manner that they twist one another. As shown by FIG. 2, the selvage threads 8, 9 run approximately transverse and tangential to the surface of cylinder 10. However, at a given twisting angle, the selvage threads 8, 9 engage the guide channel 14 of the cylinder 10 over a defined length and are guided in the guide channel 14. The selvage threads 8, 9 are located on the same side surface of the cylinder 10. The axis of rotation 16 (FIG. 1) of the cylinder 10 runs approximately parallel to the direction of motion B of the shed forming devices (harnesses 1, 2). As a result a shed is formed by the selvage forming device and the selvage threads 8, 9, such that the shed can receive the filling 37 and the shed is located in the direction of the filling in the extension of the shed 5 formed by the warps 3, 4.

Figure 3:
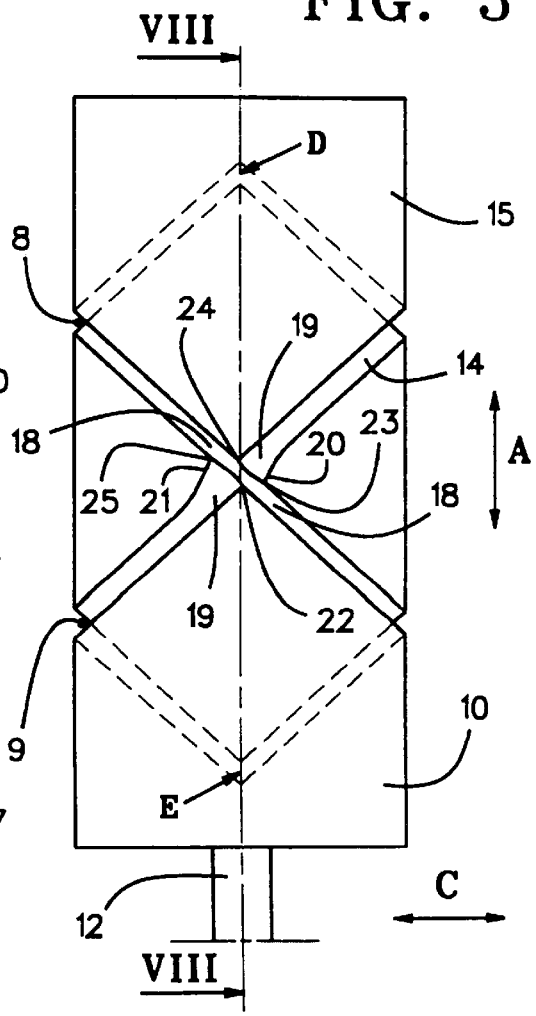
FIG. 3 is a radial view of a rotatable element having a guide channel.

The cylinder 10 shown in FIG. 3 is a radial and enlarged view that illustrated an endless guide channel 14 revolving by 360°, in two helically and oppositely directed segments 18, 19 at the cylinder 10. The helical segments 18, 19 each revolve 360° about the cylinder 10 between axial end positions D and E, situated in the axial end zones of the cylinder 10.

Figure 4:
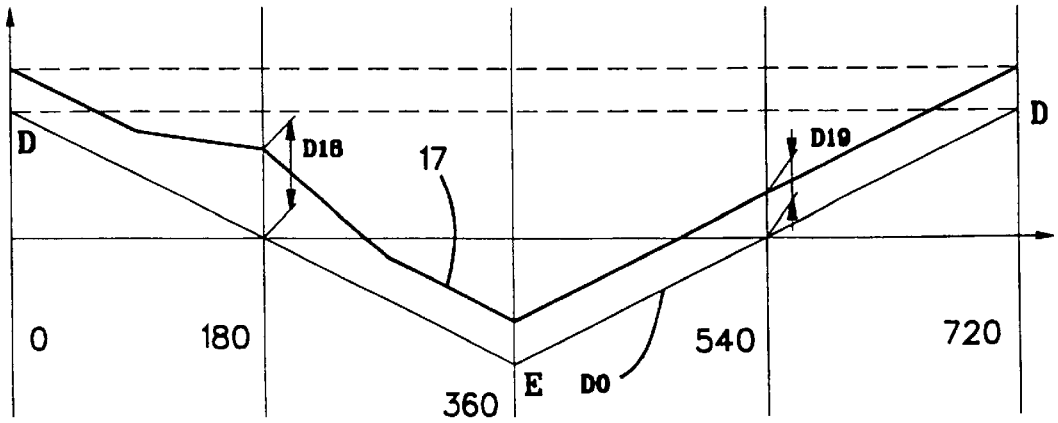
FIG. 4 shows the plots of the depth variation in the guide channel of FIG. 3.

FIG. 4 shows the function 17 of the radial depth of the guide channel 14 relative to the outer surface DO of the cylinder 10. This representation is made by showing straight lines between the end positions D, E of the guide channel 14, whereby the straight lines coincide only at 0°, 180°, 360°, 540° and 720° with the actual positions of the guide channel 14 of the cylinder 10 in the direction A. This representation was selected to more clearly show the depth function 17. As shown by FIG. 4, the segments 18, 19 are of different depths in the surface 15 at the crossing site. The selvage threads 8, 9 crossing at this crossing site therefore are situated at different radial distances from the axis of rotation and are apart. The depths of the crossing segments 18, 19 are denoted by D18 and D19.

The shallower segment 19 comprises widenings 20, 21 at the crossing site of the segments 18, 19, as a result of which a selvage thread guided in this segment 19 moves on even though the segment 19 is interrupted in the crossing site zone. Point 22 must be at a larger radial distance than point 23 and/or point 24 must be at a lesser radial distance than point 25. Because two widenings 20, 21 are provided, the cylinder 10 is rotatable in both directions of rotation. If there were only one widening 20 or 21, the cylinder 10 can only be rotated in one direction. If there were only the widening 20, the cylinder 10 may only be driven clockwise (as seen in top view), whereas if there were only the widening 21, the cylinder 10 may only be driven counterclockwise (also seen in top view). The segments 18, 19 cross at a comparatively large angle (about 90°). Such a substantial angle is advantageous because it prevents a selvage thread moving in the shallower segment 19 from penetrating the deeper segment 18 such that the selvage thread moving in the deeper segment 28 cannot easily enter a shallower segment. The presence of segments of different depths at the crossing site offers not only the advantage of moving each selvage thread in the radial direction C of cylinder 10, but also of retaining the selvage threads in their appropriate segments.

Operation and function of the selvage forming device 7 are discussed below in relation to FIGS. 2, 5 and 6. The cylinder is shown in position 0 in FIG. 2, a position at which the selvage thread 8 is higher (in FIG. 4 at 0°), and the selvage thread 9 is lower (or at 360° in FIG. 4). When the cylinder 10 is rotated by 180° in the shown direction of rotation P (opposite the direction of advance of the selvage threads 8, 9), these selvage threads 8, 9 will cross. The selvage thread 8 at the crossing site is in the lower segment 18 while the selvage thread 9 is in the shallower segment 19, as a result of which the position shown in FIG. 5 is produced. During the process, the selvage threads 8, 9 are in different radial positions in the radial direction of the cylinder 10 and are mutually spaced apart. When the cylinder is rotated once more by 180°, the selvage thread 8 will be below and the selvage thread 9 above one another. When the cylinder is rotated once more by 180°, the selvage threads 8, 9 cross again, the selvage thread 9 positioned in the lower segment 18 and the selvage thread 8 in the shallower segment 19, whereby the position shown in FIG. 6 is reached. By rotating the cylinder 10 by another 180°, the position shown in FIG. 4 is reached again. This process makes it clear that the selvage threads 8, 9 also cross in the radial direction of the cylinder 10 if they cross in the axial direction A of the cylinder 10. As a result, the selvage threads 8, 9 loop around each other.

Figure 7:
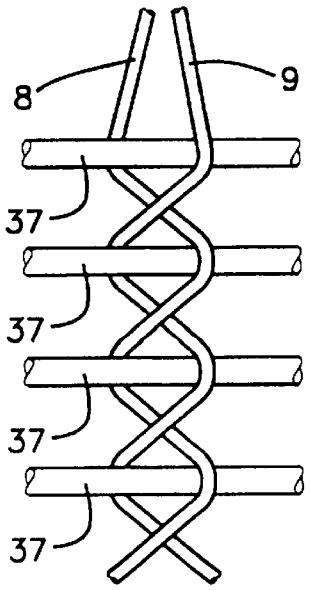
FIG. 7 is an enlargement of the cutaway F7 of FIG. 2.

FIG. 7 shows on an enlarged scale the selvage weave implemented by the selvage threads 8, 9 when the cylinder 10 is rotated by one revolution after each insertion of a filling. The selvage threads 8, 9 loop around each other and around the consecutive fillings 37, whereby the selvage forming device 7 operates jointly with the cylinder 10 as shown in FIG. 3 as a selvage rotator, that is a device that twists the selvage threads 8, 9 around consecutive fillings 37.

The described selvage weave is carried out using the guide channel 14 having the depth function of FIG. 4, using at least two selvage threads 8, 9, by guiding the selvage threads 8, 9 over a given length inside the guide channel and by shifting the positions and placement of the threads in the axial direction of the cylinder by rotating the cylinder along its axis. In this process the selvage threads 8, 9 are displaced oppositely in the axial direction A between the end positions D and E and cross one another in this axial direction A, at the crossing site which is located approximately mid-way between the end positions D and E. The end positions D and E are situated in the zones of the end faces of the cylinder 10. The depth function of the guide channel 14 makes it possible to guide and cross the selvage threads 8, 9 not only in the axial direction A of the cylinder 10, but also in the radial direction of the cylinder 10. This is possible because the segments 18, 19 are at different radial depths D18 and D19 in the crossing zone. Such a feature offers the advantage that the selvage threads 8, 9 do not rub against each other during crossing.

Figure 8:
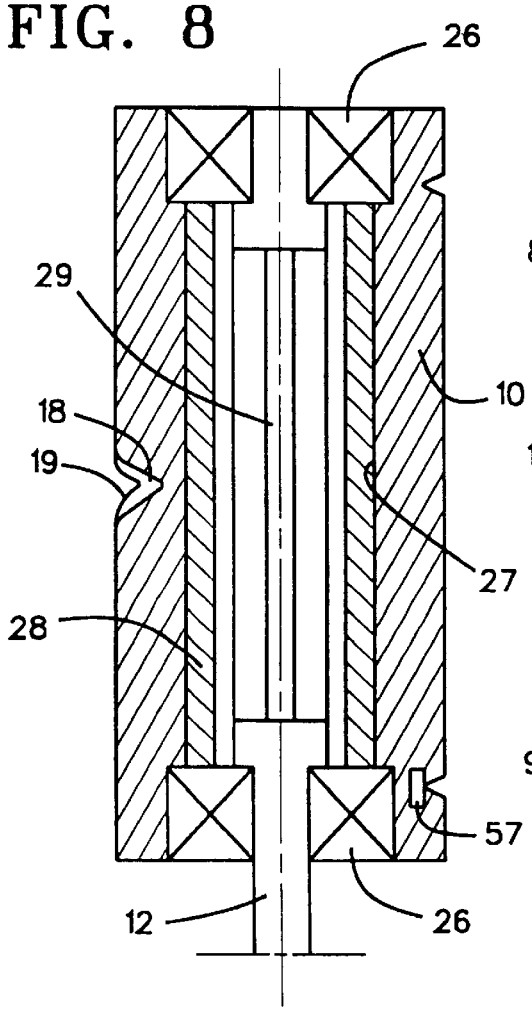
FIG. 8 is a sectional view along line VIII—VIII of FIG. 3.

As shown in FIG. 8, the cylinder 10 rests rotatably on a shaft 12 adjacent bearings 26. A drive motor is mounted inside the axial borehole 27 of the cylinder. The drive motor consists of a rotor 28 linked to the cylinder 10 and a stator 29, illustratively comprising bars, which is connected to the stationary shaft 12. The stator is fitted with windings and connected (although not illustrated) by electrical conductors to the weaving machine's control unit 38 (shown in FIG. 1).

An angular-rotation pickup (not shown) is mounted on the cylinder 10 to feed the cylinder's angular positions into the control unit 38 so that the control unit 38 can drive the motor and thus the cylinder 10 at a predetermined speed, to a predetermined position. In one embodiment a stepping motor that is driven by the control unit 38, is integrated into the cylinder. Integrating the drive motor into the cylinder 10 offers the advantage that the selvage forming device 7 can be miniaturized and consist of few elements. This selvage forming device 7 may be modular and, in particular, it can simply be assembled onto or disassembled from a weaving machine. As a result said device 7 can be matched to the width of a fabric 6 for instance by merely shifting the frame 11.

As shown by FIG. 8, the segments 18, 19 of the guide channel 14 are cross sectionally V-shaped. Obviously other cross-sectional shapes are also possible, which would differ in their slope and angle, and which would appropriately be rounded.

The supply unit 13 appropriately contains a drive motor (not shown) that is actuated by the weaving machine's control unit 38. This drive motor is controlled at the same angular speed as the drive motor of the cylinder 10, but in a direction of rotation that untwists the selvage threads 8, 9 that were rotated by the cylinder 10. In addition, compensating devices (not shown) may be present in the vicinity of the supply unit 13 to keep the selvage threads 8, 9 stretched at a predetermined tension.

Figure 9:
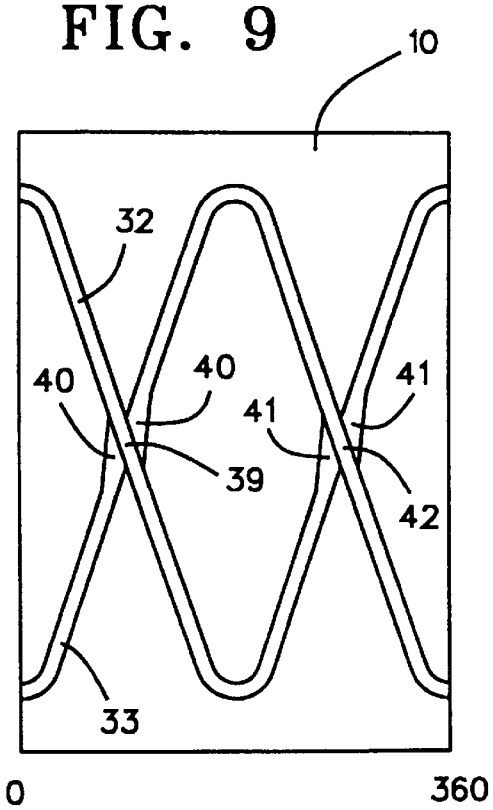
FIG. 9 is a view of the geometric development at the surface of a rotatable element having two guide passages.

The selvage weave shown in FIG. 7 can also be implemented with a cylinder 10 having two guide channels 32, 33 as shown in FIG. 9.

FIG. 9 shows the geometric development of the surface of the cylinder 10 and the shape of the two guide channels 32, 33. The guide channels 32, 33 run as endless turns over 360° on the surface of the cylinder 10 and cross two times per revolution of this cylinder. The guide channels 32, 33 are configured at their crossing locations with segments 39, 40 and segments 41, 42 having different depths. The segment 39 of the guide channel 32 is deeper than the segment 40 of the guide channel 33. The segment 41 of the guide channel 32 is shallower than the segment 42 of the guide channel 33. The shallower segments 40 and 41 are formed outward as shown in FIG. 3 and comprise widenings by which each selvage thread is held in the segments 40 and 41. A selvage thread 8 is kept in the guide channel 32 and a selvage thread 9 in the guide channel 33 to achieve the selvage weave of FIG. 7. The cylinder is driven in such manner that it carries out a rotation of 180° per insertion filling. The guide channels 32, 33 run in a mirror symmetrical manner relative to the axial center of the cylinder 10 and are shaped in such a way that the axial end positions are reached twice over a peripheral angle of 360°, or each time after a peripheral angle of 18020 . When the slope of the helical guide channels 32 and 33 is to remain equal to the slope of the guide channel 14 of the embodiment of FIG. 3, then, in the embodiment of FIG. 9, a cylinder 10 must be used in which the diameter is double that of the cylinder 10 of FIG. 3.

Figure 10:
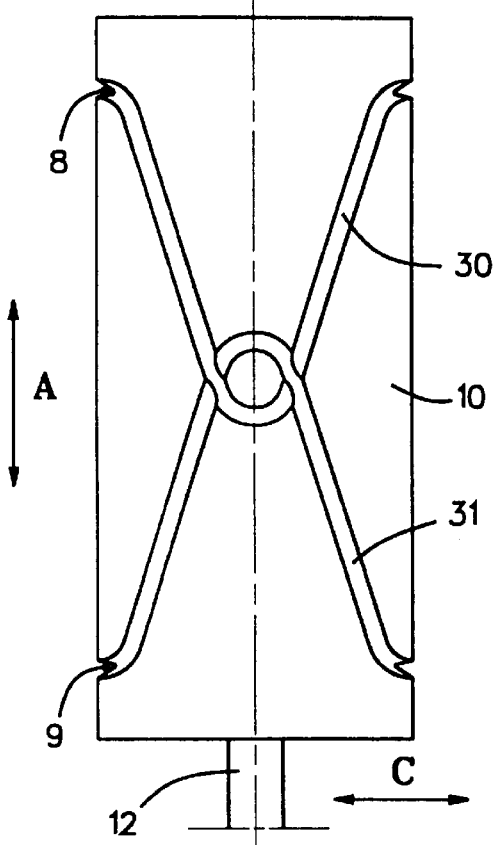
FIG. 10 is a radial view of a rotatable element having two guide passages, each passage only running approximately as far as the axial middle position.
Figure 11:
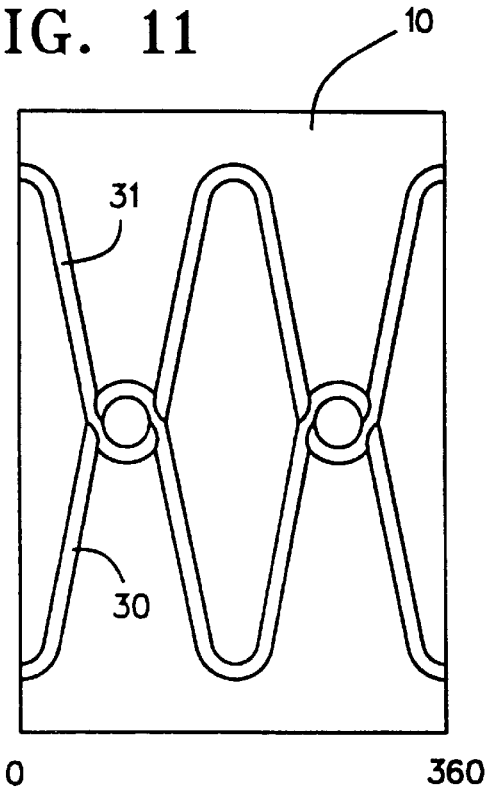
FIG. 11 is a view of the geometric development at the surface of the rotatable element of FIG. 10.

In the embodiments of FIGS. 10 and 11, the cylinder has two guide channels 30 and 31 each guiding a selvage thread 8 or 9. The guide channel 30 runs in the form of an endless turn from the zone of the upper cylinder end face somewhat beyond the axial center. The guide channel 31 runs from the zone of the lower cylinder end, also somewhat beyond the axial center. Over a peripheral angle of 360° the guide channels 30, 31 run twice to-and-fro between their axial end positions, and accordingly they cross four times per revolution of the cylinder 10, that is, they form four crossing locations. The depth function 17 of the guide channels 30 and 31 is represented by solid lines for the deeper segments and by broken lines for the shallower ones. For the sake of clarity, the shallower segments comprise the widenings shown in FIGS. 3 and 9—which are not shown from FIGS. 10 and 11.

The guide channel 30 has constant depth, whereas the guide channel 31 is of variable depth whereby the guide channel 31 can be deeper and shallower than the guide channel 30. Obviously both guide channels 30 and 31 may be designed with each channel having a variable depth. Because the depths of the segments of the guide channels 30, 31 are different at the crossing locations, the selvage threads 8, 9 both cross in the axial direction A and in the radial direction C of the cylinder 10. The selvage threads 8, 9 cross at crossing locations which are pairwise and mutually offset by 180° at the periphery of the cylinder 10.

Figure 12:
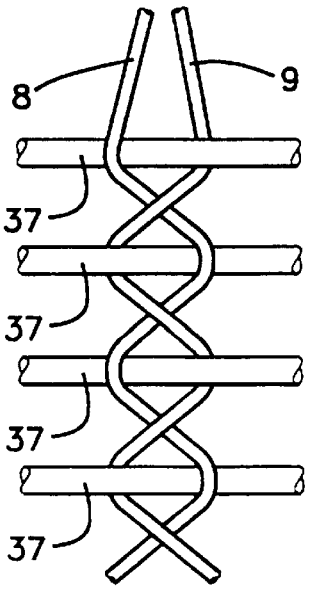
FIG. 12 is a view of a selvage weave formed by the rotatable element of FIG. 10.

When the cylinder 10 of FIG. 10 is rotated at constant speed so that it is rotated by 180° at each insertion of a filling, a selvage is formed as shown in FIG. 12 by the selvage thread 8 guided in the guide channel 30 and the selvage thread 9 guided in the guide channel 31. The selvage device 7 constituted by the cylinder 10 of FIG. 10 operates in this process as, a so-called, half selvage rotator which loops the selvage threads 8, 9 of FIG. 12 half-way around consecutive fillings 37. In this process the supply unit 13 is motionless.

Figure 13:
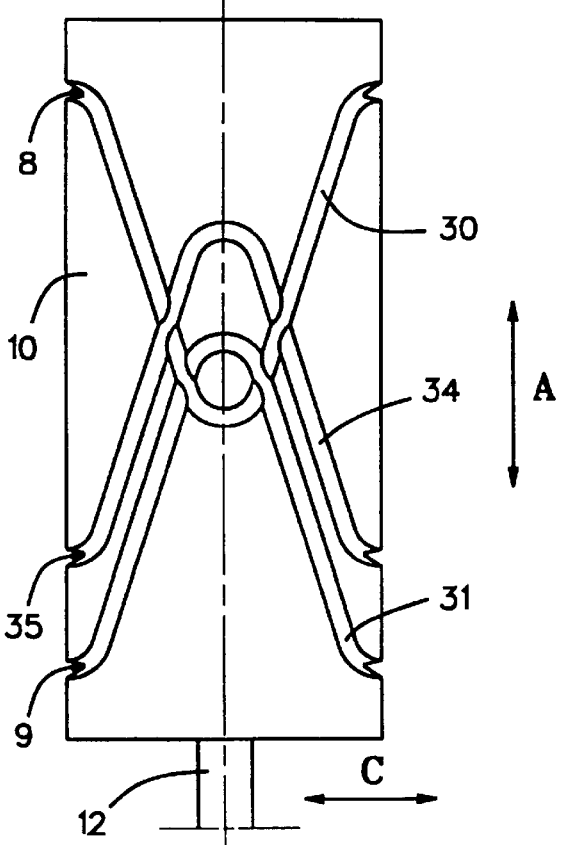
FIG. 13 is a radial view of a rotatable element having three guide channels.
Figure 15:
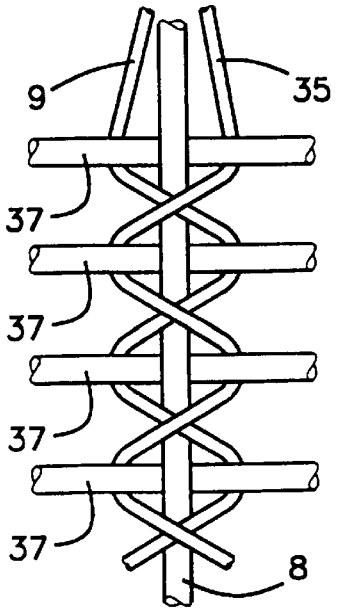
FIG. 15 is a view of a selvage weave made by the rotatable element of FIG. 13.
Figure 14:
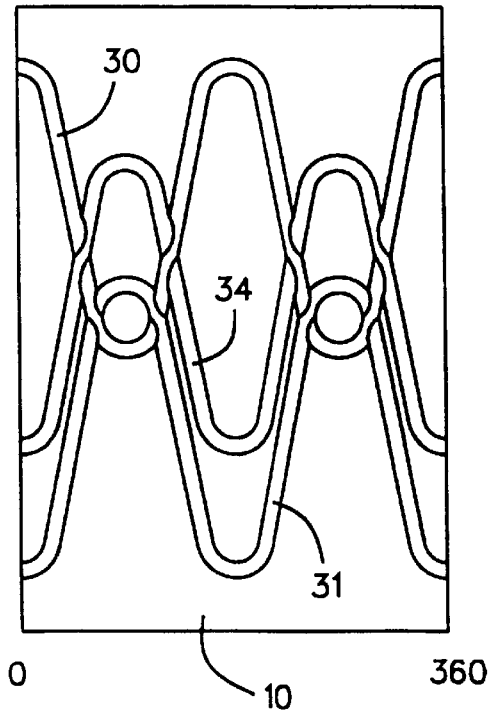
FIG. 14 is a view of a geometric development at the surface of the rotatable element of FIG. 13.

In the embodiment of FIGS. 13 and 14, the cylinder 10 is configured with three guide channels 30, 31, 34, each of the channels guiding one selvage thread 8, 9, 35 respectively. The three guide channels 30, 31, 34 have a depth function by means of which a selvage weave is made as shown in FIG. 15, using the three selvage threads 8, 9, 35. The guide channels 30, 31 of the embodiment of FIGS. 13 and 14 are designed to correspond to the guide channels 30, 31 of the embodiment of FIGS. 10 and 11. The guide channel 34 runs parallel to the guide channel 31 while being axially offset in the direction of the cylinder 10, forming a total of 4 crossing locations with the guide channel 30 over 360° on the periphery of the cylinder 10. As shown by FIG. 13, the guide channel 34, when crossing at the crossing site of the guide channel 30, will be deeper if the ensuing crossing site of the guide channel 30 and the guide channel 31 is of greater depth. Inversely the guide channel 34 crossing the guide channel-30 at the crossing site is shallower if, at the next crossing site of the guide channels 30 and 31, the guide channel 31 is deeper. If the cylinder 10 shown in FIG. 13 rotates at a constant speed about 180° at each insertion of a filling, then the selvage thread 8 guided in the guide channel 30, the selvage thread 9 guided in the guide channel 31 and the selvage thread 35 guided in the guide channel 34 will form a selvage weave as shown in FIG. 15. In this process, the supply unit 13 is motionless.

Even though the guide channels 31, 34 of FIGS. 13 and 14 are shown to be comparatively at a large distance apart, in practice they should be fairly closely adjacent in the axial direction A of the cylinder 10. Widenings (not shown) for the shallower segments of the particular guide channels 30, 31, 34 are present in the embodiment of FIGS. 13 and 14 in the zones of the crossing locations and correspond to the widenings of the embodiment of FIG. 3.

Figure 16:
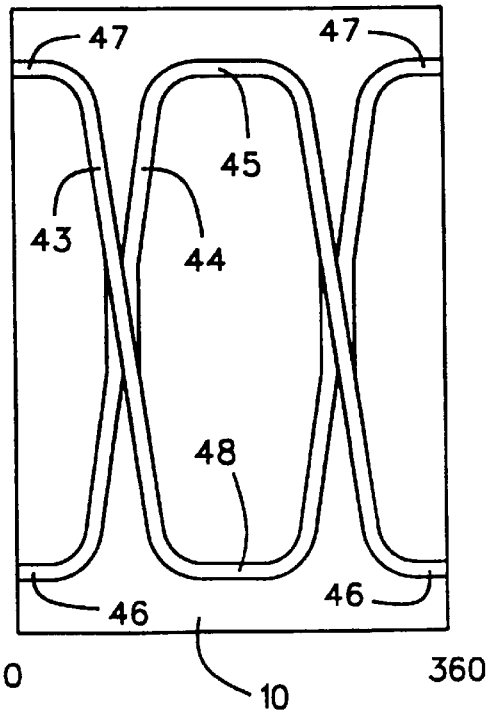

FIG. 16 shows a cylinder 10 with guide channels 43, 44 each intended to guide a particular selvage thread 8, 9 to allow implementing the same selvage weave as with the cylinder 10 of FIG. 9 that is configured with guide channels 32, 33. The guide channels 43, 44 are configured at their axial end positions with segments 45, 46, 47, 48 running over a larger peripheral angle, for instance about 60° in the circumferential direction of the cylinder 10. Because of these peripheral segments 45 through 48, the cylinder may be rotated by a corresponding circumferential angle without the selvage threads 8, 9 leaving their axial end positions. This situation is especially advantageous for a selvage forming device 7 used in a gripper weaving machine because the shed formed by the selvage threads 8, 9 can be kept fully open over a substantial period of time, as a result of which the grippers mounted on a gripper belt can safely pass through the shed.

As regard to a variation in the embodiment of FIG. 16, the guide channels are configured with peripherally running segments 45, 47 or 46, 48 only in the zone of one end face, whereas immediate axial reversal takes place in the zone of the opposite end face. Such an embodiment is appropriate for gripper weaving machines wherein the gripper belt is guided substantially in the vicinity of the upper or lower set of warps of a shed. In this case, the peripheral segments 45, 47 or 46, 48 are present in the zone of the end face of the cylinder 10 containing gripper belt of one gripper.

In another embodiment (not shown), the cylinder is configured with more than three guide channels guiding selvage threads that illustratively also cross one another several times. For instance a cylinder 10 may be configured with a guide channel 14 corresponding to FIG. 3 and with a guide channel 34 corresponding to FIG. 13 that cross each other. Appropriately the guide channels 14 and 34 will be- of different depths at each crossing site, whereby the selvage threads are mutually displaced in the radial direction C of the cylinder 10 while simultaneously being prevented from unduly passing from one guide channel into another. In a further appropriate manner, the mutually crossing segments of the guide channels are configured with suitable widenings in the manner of FIGS. 3 and 9.

The cylinder 10 can be driven in such manner that it will always rotate in the same direction. Such a feature, however, is not mandatory when the guide channel segments in the zone of the crossing locations are configured with the appropriate widenings which allow the rotation of the cylinder 10 in either direction. Illustratively, a cylinder 10 designed as in FIGS. 1 through 6 may carry out a predetermined number of revolutions in one-direction, for instance five, and then it may be rotated by as many revolutions in the other direction. In such a case, a stationary supply unit 13 may be used.

Nor is it mandatory that the cylinder 10 be rotated constantly. For instance it may be kept in a position at which, over the time interval of one or several insertion of a fillings, an open shed is formed between the selvage threads 8 and 9. When, upon insertion of a filling, the cylinder 10 is rotated again, a selvage weave is obtained in which several fillings are simultaneously woven into the selvage thread warps. Preferably however the cylinder 10 is rotated constantly to weave each filling and thereby achieve firmer weaves.

Different selvage weaves can be implemented in a simple manner by appropriately shaping the guide channels 14, 30, 31, 32, 33, 34, 43, 44 of the cylinder 10 and rotating the cylinder 10 in a controlled manner. The guide channels also may deviate from the shapes discussed in the above shown embodiments, and their depth function at the crossing locations also may be different to arrive at a desired selvage weave.

Preferably the guide channels will be relatively narrow to secure accurate guidance of the selvage threads. The above described widenings in the zone of the crossings may also be replaced by constrictions to the guide channels at particular channel walls. This latter feature entails for instance, with respect to the embodiment of FIG. 3 that, in place of the widening 20, 21, the point 24 will be at a lesser radial distance and the point 22 at a larger radial distance, whereby points 22, 23, and points 24 and 25 are arranged in the axial direction A of the cylinder 10 in the manner shown in FIG. 3. However, as narrow guide channels are preferred, implementing the constrictions will be fairly difficult. On that account using widenings is preferred.

To limit the size of a selvage forming device 7, preferably a cylinder 10 of small diameter will be used. As regard to a selvage forming device of the invention, the selvage threads are best guided in such manner that the slope of the guide channels will not be excessive, and for such a purpose cylinders 10 of larger diameters are advantageous. As regard to sheds with aperture angles as occurring in rapidly operating, shuttleless weaving machines, good results are obtained from a cylinder 10 with a diameter between 3 to 6 cm approximately.

Furthermore, the cylinder guide channels also may be designed in such manner that they run several times to-and-fro between the axial end positions over a peripheral angle of 360°. Two guide channels 49, 50 are used in the illustrative embodiment of FIG. 17, each running over a peripheral angle of 90° between the two axial end positions, whereby these guide channels move to-and-fro between the selvage threads 4 times per revolution between the end positions and correspondingly cross them 4 times. As a consequence, the diameter of the cylinder 10 must be enlarged when the slope of the helical guide channels 49, 50 will not be excessively steep. In such case however the cylinder 10 may run only at low angular speed. Illustratively the cylinder 10 of FIG. 17 must run at half the speed of the cylinder 10 of the embodiment of FIG. 9 in order to implement the same selvage weave.

Clearly the cylinder 10 and the guide channels or guide passages present in it may not be shaped in such manner that following one cylinder revolution the selvage threads would be displaced from one axial end position to the other. This displacement also may take place only after two or more revolutions of the cylinder 10 which then must be driven at a corresponding high speed to form a shed for a insertion of a filling. In the embodiment of FIG. 18, the cylinder 10 is configured with a guide channel 51 for which the particular axial end positions are reached only after two revolutions of the cylinder 10. This feature makes it possible to use a cylinder 10 with a smaller diameter, or, at least equal diameter, to reduce the slope of the helical guide channel 51 (especially with respect to the illustrative embodiment of FIG. 3). The slot 51 crosses itself at three locations, namely at the crossing locations F, G and H. However the selvage threads 8 and 9 cross one another only at the crossing location H. The crossing locations F and G merely require design steps preventing the selvage threads from slipping out of the particular segments in which they are guided. Moreover, the already described design steps (namely different depths) also must be implemented at the crossing location H so that the selvage threads can be moved simultaneously into mutually radial deviating positions. To implement a weave as shown in FIG. 7, the cylinder 10 of FIG. 18 must be rotated twice as fast as the cylinder 10 of FIG. 3.

The guide passages of a cylinder 10 for a selvage forming device 7 are not necessarily guide channels. As shown in FIG. 19, the cylinder 10 is configured with protrusions 53 subtending between themselves along thread guide indentations 54, 55. Elevations 56 are present at the crossing location of the guide passages 54, 55 formed by the protrusions 53 in order to guide the mutually crossing selvage threads at a different radial distance. Using a selvage forming device 7 with a cylinder 10 as shown in FIG. 19, a selvage weave can be created as shown in FIG. 7, similar to the-embodiment of FIG. 9. The protrusions 53 and elevations 56 are shown, in FIG. 19, shaded for clarity, though they are not sectional.

The rotatable element need not be a cylinder, instead its shape may deviate from a cylinder, for instance it may be oval, that is, it may be a rotatable element of oval cross-section. The segments of the guide channels or guide passages in the zone of the thread crossing locations then also will be of different depths in order that these threads, when crossing, will be apart in the radial direction C. Moreover, a rotatable element deviating from the cylindrical shape may be used with an integrated drive motor, that is, it may be driven in a manner corresponding to that of the cylinder 10 in FIG. 8.

The cylinder 10 may be configured with thread-rupture detectors in the zone of the guide channels or passages. As regard to the embodiment of FIG. 8, a sensor, for example, a piezoelectric sensor 57, is mounted in the zone of the guide channel 14 that will transmit, for instance by radio waves, a signal to the control unit 38 when a selvage thread 8 or 9 passes by. In such a design two signals are transmitted to the control unit 38 per revolution of the cylinder 10. If only one signal, or none, is transmitted per revolution of the control unit 38, thread rupture will have been detected. Obviously, optical and mechanical sensors, and those operating in other ways, also may be used to detect thread rupture. In this instance the signals may be transmitted by wire or the like to the control unit 38.

Switches or the like connected to the control unit 38 also may be mounted in the vicinity of the selvage forming device 7, which, when actuated, drives the cylinder 10 into a specified position, illustratively to manually move the selvage threads 8, 9 into the guide passages or channels.

In the above embodiments, the rotatable element is a tubular cylinder 10 with a cylindrical outer surface 15. However the rotatable element may also be so designed that material will be present only in the zone of the guide passages or channels. This means that the cylinder 10 need not be of solid material.

As shown in dashed lines in FIG. 2, a guide element 58 may be present in the vicinity of the rotatable element to maintain the selvage threads 8, 9 in the guide passages or channels of this rotatable element. As regard to an embodiment not shown, several rotatable elements 10 are used along the weaving machine to appropriately cooperate with several pairs of selvage threads in order to twist each particular pair of threads and to form special weaves with inserted fillings.

The method of the invention also may be used for twisting, that is, a cylinder 10 corresponding to one of the embodiments of FIGS. 1 through 19 may be used as a twisting device for a twisting frame. In such an application, an embodiment may be illustratively used wherein the twisting device must contain the rotatable element 10 together with its drive means, a supply unit 13 and an omitted thread winding device. As regard to a twisting device, the rotatable element furthermore may be mounted horizontally or in another position.

The invention is not restricted to the shown and described embodiments. Instead the scope of protection is determined by the contents of the claims.

The present invention is by no means restricted to the above-described preferred embodiments, but covers all variations that might be implemented by using equivalent functional elements or devices that would be apparent to a person skilled in the art, or modifications that fall within the spirit and scope of the apppended claims.

What is claimed is:

1. A method for twisting at least two moving threads comprising:

running the threads substantially transversely and substantially tangentially relative to a rotatable element having at least one guide passage and guiding each thread in the at least one guide passage of the rotatable element; and causing the displacement to-and-fro of the threads in the axial direction of the rotatable element between two end positions and their mutual crossing between these end positions.

2. The method as claimed in claim 1, further comprising:

arranging said at least one guide passage so that it guides the threads at a mutual radial spacing when they are mutually crossing each other.

3. An apparatus to twist at least two threads, comprising:

a rotatable element having a surface configured with at least one endless guide passage that runs helically in axial direction of said rotatable element between at least two axial end positions that includes at least one crossing location for the at least two threads, and that guides at least two threads extending substantially transversely and approximately tangentially relative to said rotatable element.

4. The apparatus as claimed in claim 3, wherein mutually crossing segments of the at least one endless guide passage are located at different radial depths, at least at the crossing locations of the threads.

5. The apparatus as claimed in claim 3, wherein the at least one guide passage comprises segments in a zone of at least one of the end positions with segments extending in a peripheral direction of the rotatable element.

6. The apparatus as claimed in claim 3, wherein the rotatable element is mounted on a shaft of an electric drive motor.

7. The apparatus as claimed in claim 3, wherein the at least one guide passage is in the form of a guide channel on the surface said rotatable element.

8. The apparatus as claimed in claim 3 wherein at least one segment of the guide channel is of variable depth.

9. The apparatus as claimed in claim 3 wherein the rotatable element comprises a guide passage configured with a segment running over 360° of a periphery of a cylinder surface of the rotatable element from one axial end position to another axial end position and with a segment running at an oppositely directed slope over 360° of the periphery of the cylinder surface between the axial end positions, whereby the two segments subtend a crossing location approximately centered between the end positions of the cylinder surface.

10. The apparatus as claimed in claim 3 wherein the rotatable element comprises at least two endless guide passages which run over a peripheral angle of 360° of the rotatable element at least twice between the axial end positions and the guide passages cross one another at least twice per revolution of the rotatable element.

11. The apparatus as claimed in claim 10, wherein the at least two guide passages extend between an end position in a zone of an axial end of the rotatable element and an end position in a zone of the axial center of the rotatable element, and crossing locations are provided in a zone between the end positions.

12. The apparatus as claimed in claim 3, wherein a segment of the at least one endless guide passage having a lesser radial depth at the crossing location is widened at least unilaterally at the crossing location.

13. An Apparatus to twist at least two threads in combination with a weaving machine, comprising:

a rotatable element having a surface configured with at least one endless guide passage that runs helically in axial direction of said rotatable element between at least two axial end positions that includes at least one crossing location for at least two threads, and that guides at least two threads extending substantially transversely and approximately tangentially relative to said rotatable element.

14. The apparatus as claimed in claim 13, wherein the weaving machine comprises a selvage forming device and the rotatable-element acts as the selvage forming device of the weaving machine and twists selvage threads together.

15. The apparatus as claimed in claim 13, wherein the rotatable element further comprises a rotation shaft that extends essentially parallel to a direction of motion of a shed forming device of the weaving machine.

16. The apparatus as claimed in claim 13, wherein the rotatable element is configured to twist the threads in said apparatus.

17. An apparatus to twist at least two threads in combination with a twisting machine, comprising:

a rotatable element having a surface configured with at least one endless guide passage that runs helically in axial direction of said rotatable element between at least two axial end positions that includes at least one crossing location for the at least two threads, and that guides at least two threads extending substantially transversely and approximately tangentially relative to said rotatable element.

* * * * *

UNITED STATES PATENT AND TRADEMARK OFFICE

CERTIFICATE OF CORRECTION

PATENT NO. : 6,227,253 B1
DATED : May 8, 2001
INVENTOR(S) : Meyns

It is certified that error appears in the above-identified patent and that said Letters Patent is hereby corrected as shown below:

Title page,
Insert Item -- [30] Foreign Application Priority Data
Sept. 30, 1996 (BE) …….. 9600823 --.

Signed and Sealed this

Second Day of July, 2002

*Attest:*

*Attesting Officer*

JAMES E. ROGAN
*Director of the United States Patent and Trademark Office*